United States Patent [19]

Scott

[11] 3,960,134

[45] June 1, 1976

[54] UTENSIL HOLDER FOR STOVE

[76] Inventor: Elmira J. Scott, 8605 Longworth, Waterford, Mich. 48095

[22] Filed: Nov. 4, 1974

[21] Appl. No.: 520,473

[52] U.S. Cl. ..... 126/24; 126/42
[51] Int. Cl.[2] ..... F24C 15/10
[58] Field of Search ..... 126/24, 42, 218, 215, 126/211; 220/85 H; 248/311, 310

[56] References Cited

UNITED STATES PATENTS

| | | | |
|---|---|---|---|
| 1,728,107 | 9/1929 | Conover | 126/42 |
| 2,425,271 | 8/1947 | Tandler | 126/24 X |
| 2,878,803 | 3/1959 | Del Papa | 126/24 |
| 3,288,130 | 11/1966 | Pollock | 126/215 |
| 3,372,688 | 3/1968 | Moore | 126/24 |
| 3,583,384 | 6/1971 | Ranisate | 126/24 |
| 3,658,049 | 4/1972 | Gerber | 126/215 |

FOREIGN PATENTS OR APPLICATIONS

| | | | |
|---|---|---|---|
| 332,913 | 9/1919 | Germany | 126/211 |

*Primary Examiner*—William F. O'Dea
*Assistant Examiner*—Harold Joyce

[57] ABSTRACT

A device not limited to but particularly adapted for retaining a cooking utensil on gas stoves currently provided in motor homes, pickup campers, trailers, boats and the like, the stove having a bar-type grate secured thereto on which the utensil is supported, comprises a hollow, expandable-circumference cylinder, preferably formed by rolling a sheet metal blank, having means formed integrally therewith for removably securing the same to the grate, the cooking utensil being encircled by and restrained from sliding off the grate by the device.

7 Claims, 13 Drawing Figures

UTENSIL HOLDER FOR STOVE

BRIEF SUMMARY OF THE INVENTION

This invention relates generally to the art of stoves, particularly to means for preventing cooking utensils from slipping or being otherwise inadvertently dislodged or overturned from a stove, such as, for example, the grate of a gas stove, commonly used in motor homes, pickup campers, trailers, boats and the like, and more particularly to a device for such purposes that is adapted for use without any modification to existing utensils and stoves.

Means for maintaining shipboard stoves level, devices such as utensil tongs for galley stoves and other devices, such as rings fixed to a stove to encircle a cooking utensil, and even cooperating, specially-formed utensils with means for locking engagement with specially-formed stove grates, have been proposed in the art.

However, some of these proposed prior art devices are relatively complex and expensive, or they extend across the entire stove top so as to be inconvenient to use or store. Other such devices involve special stove and/or utensil structure; that is, either the stove or the utensil, or both, are originally specially made with such features. In any event, for whatever reason, such devices are not in common use today.

Accordingly, one main object of this invention is to provide a utensil holder device for, or in combination with, a stove, whereby an ordinary utensil without special structure may be safely retained on and prevented from slipping from an ordinary stove grate having no special structure for that purpose, even though the boat, motor home, pickup camper or other recreational type vehicle in which the stove is mounted may be subjected to accelerations, decelerations, bumps or attitudes that would otherwise cause the utensil to slide off the stove or tip over. Further, as will be seen, such a device may also find use in the home.

Another object of the invention is to provide such a device that is exceedingly simply in structure and easy to construct and use.

Another object of the invention is to provide such a device that will accommodate and snugly encircle more than one size of cooking utensil.

A further object of the invention is to provide such a device that will adapt itself to more than one particular stove grate design.

Another object of the invention is to provide such a device whereby a set of two or more such devices for a particular stove grate design will accommodate utensils of varying sizes.

A still further object of the invention is to provide such a device that provides greater utensil stability and more efficient heating of the utensil than prior art devices, without obstructing the stove top.

Another object of the invention is to provide a device that can be employed with gas stoves having bar-type grates, and, if desired, with electric stove, flat spiral type heating elements.

A further object of the invention is to provide such a device comprising an expandable metallic cylinder having grate or heating element engaging means thereon, the expandable cylinder accommodating varying sizes of utensils and grates or heating elements.

These and other objects and advantages of the invention will become more apparent by reference to the following description of the appended drawings.

DETAILED DESCRIPTION

Figure 1:
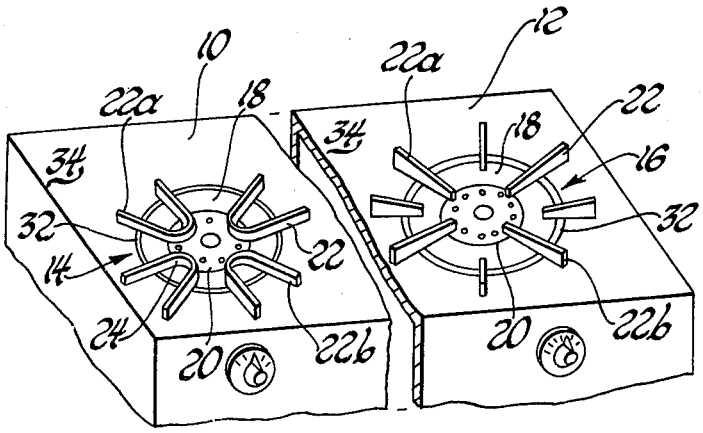
FIG. 1 is a fragmentary perspective view of a gas stove to which the invention is applicable, the specific grate structures being different on opposite sides of the broken line.

Referring now to the drawings in greater detail, wherein certain common elements or features of different embodiments are designated by the same reference numbers, FIG. 1 illustrates fragmentary top portions 10 and 12 of gas stoves having typical and generally similar, but specifically different, burner grate structures 14 and 16. The stove burners or heating elements are similar in that they both include the usual dished drip pan 18 surrounding the gas burner jet 20 and a utensil-supporting grate, of which there undoubtedly are a variety of specific designs. However, grates 14 and 16 are similar in that they each include eight radially-extending bars 22. In grate 16, the bars are separate; in grate 14, pairs of adjacent bars are joined, comprising V-shaped elements 24.

Figure 2:
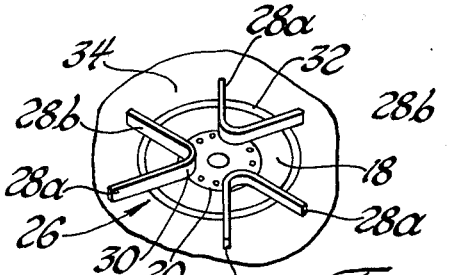
FIG. 2 is a perspective view of another common gas stove grate structure to which another specific configuration of the invention is applicable.

FIG. 2 illustrates a grate 26 having six, rather than eight, radially-extending bars 28, comprising three V-shaped grate members 30, the V-shaped members 30 being similar to members 24 of grate 14 in FIG. 1. Of course, the grate 26 of FIG. 2 could comprise six separate bars, just as grate 16 of FIG. 1 comprises eight separate bars 22, without V-shapped members.

In each case however, the radially-extending bars, which may vary slightly in width and height from stove to stove, rest on and are secured to or formed integrally with circular support rings 32, so that the bars are spaced vertically above the burner 20, as well as above the upper horizontal surface 34 of the stove. In stoves for boats, motor homes and the like, means are provided (not shown) for removable securing the grates, such as grate 14, to the stove top so that they cannot be inadvertently dislodged from the stove. That is, since the grate is secured to the stove, anything secured to the grate is also secured to the stove, this being a main principle upon which the invention is based.

Figure 3:
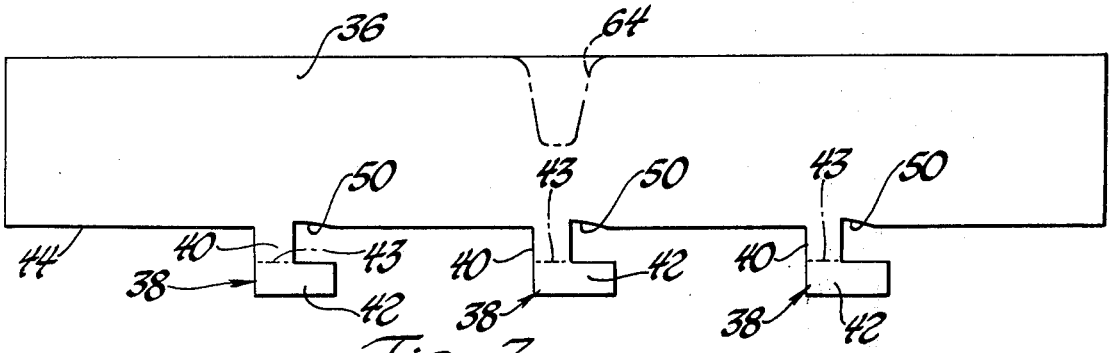
FIGS. 3 and 7 are plan views of blanks for two specific configurations of the invention.

Referring now to FIG. 3, one configuration of a device (shown by FIGS. 5 and 6) embodying the invention is formed by first providing a blank 36, such as by stamping, preferably from stainless steel or other suitable non-combustible material, having three generally L-shaped integral projections or tabs 38 extending from one side thereof. While precise dimensions are of no particular significance, a typical blank such as that shown by FIG. 3, in order to accommodate known utensils and grate designs, may be on the order of 17 long and 2½ inches wide, the legs 40 and 42 of the L-shaped projections being ½ inch wide and bottom legs 42 being spaced ½ inch from the lower edge 44 of the blank 36. Preferably, all corners are slightly rounded to prevent injury to the user.

Obviously, the bottom legs 42 of the L-shaped tabs 38 can extend in either direction, so long as they all extend in the same direction. Alternatively, the tabs possibly could be shaped other than an L-shape, a T-shape, for example.

Figure 4:
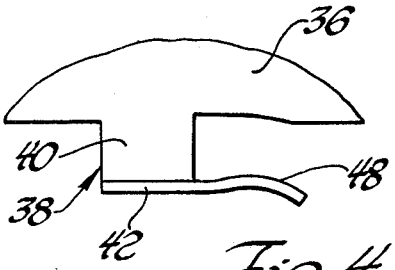
FIG. 4 is fragmentary view illustrating one step in the formation of a device embodying the invention.
Figure 5:
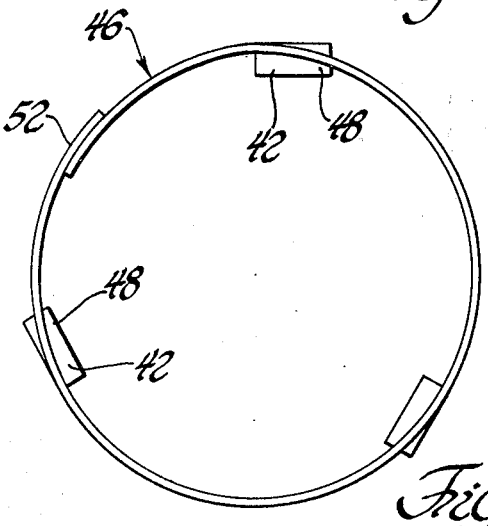
FIGS. 5 and 6 illustrate top and bottom views of the final form of that configuration of the invention shown in blank form in FIG. 3.
Figure 6:
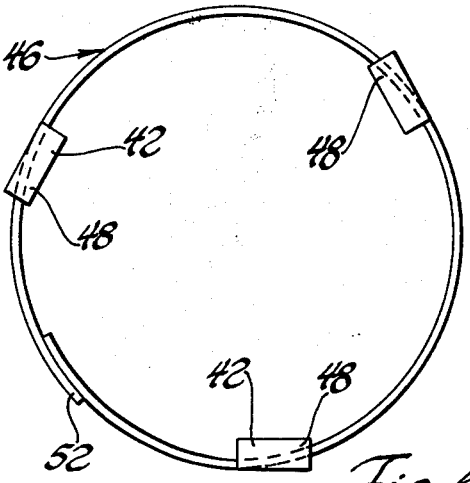

Starting with the blank 36 shown in FIG. 3, the device 46 (see FIGS. 5 and 6) is completed by the following three steps, which may be done in any desired order: (1) the blank is rolled to provide a cylinder, (2) the bottom legs 42 of the tabs 38 are bent to a position normal to the legs 40, (3) the legs 42 are each bent to provide a spring clip portion 48, as shown in FIGS. 4, 5 (top view) and 6 (bottom view), for purposes to be described. A slightly different embodiment is shown in use in FIG. 8.

It should be noted that (a) the lower edge 44 of the blank 36 is formed with a tapered notch 50 adjacent each leg 40, (b) the blank 36 is rolled to a diameter such that the ends thereof overlap, as at 52, at substantial distance and (c) the bottom legs 42 are preferably bent inwardly, rather than outwardly, with respect to the axis of the cylindrical device 46. It is possible, however, that under certain circumstances the legs 42 may be bent outwardly. The extent of the overlap 52 is variable, although to some extent limited, as will be explained.

With the blank 36 rolled so that the ends overlap at 52 in the free state of the device 46, it will be appreciated that the device is resiliently expandable in its circumference, and thus in its diameter. Actually, since the device 46 is a split cylinder, its diameter and circumference are also resiliently contractable. Of course, the resiliency and limit of the expansion and contraction of the device is limited by its material, wall thickness and elastic limit. Further, as will be seen, expansion and contraction is limited, to some extent, by the specific embodiment of the device and the particular stove grate design to which it is to be applied.

Figure 7:
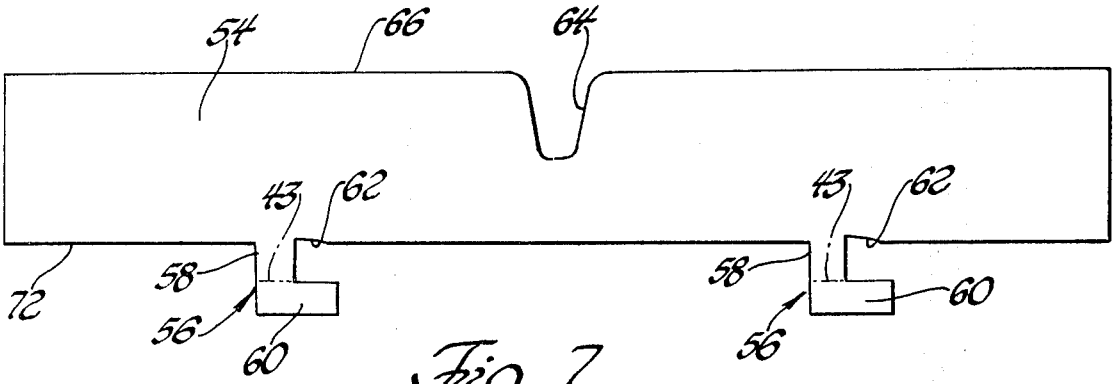

FIG. 7 illustrates a blank 54 for a somewhat different embodiment of the invention, the blank 54 having L-shaped tabs 56 with leg portions 58 and 60, and notches 62, similar to the blank of FIG. 3. The main differences between blank 54 of FIG. 7 and blank 36 of FIG. 3 is that blank 54 has two, rather than three, tabs and a notch 64 formed in the upper edge 66 thereof. While notch 64 is shown as formed approximately at the center of the blank, it could be shifted toward either end of blank 54. Also, a notch 64 could be formed in blank 36 of FIG. 3, as shown by the broken line.

The device 68 resulting from blank 54 of FIG. 7 is made or formed in the same manner as explained above in connection with the device 46 resulting from blank 36 of FIG. 3.

Figure 8:
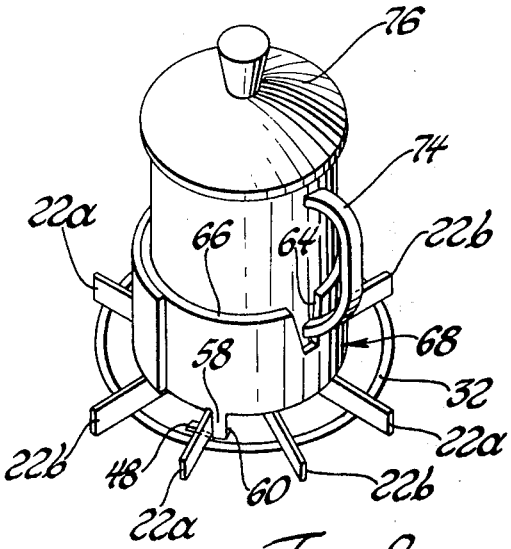
FIG. 8 is a perspective view of a conventional cooking utensil retained upon a conventional cookstove grate by a device embodying the invention.
Figure 9:
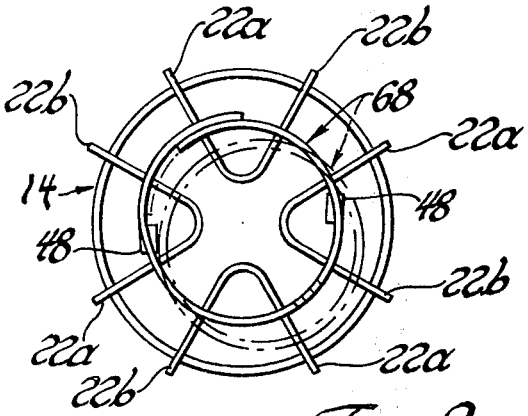
FIG. 9 is a plan view of one configuration of a device embodying the invention as applied to a gas stove grate.

The reason for providing both a two-tab and a three-tab device is related to grate design. Referring to FIGS. 1, 8 and 9, it will be seen that whatever the specific construction of the eight-bar grate, there is always a pair of oppositely-disposed bars, such as bars **22*a* or 22*b***, disposed substantially along the diameter of the grate, the angle therebetween being approximately 180°. The same would be true of a four-bar grate.

Figure 12:
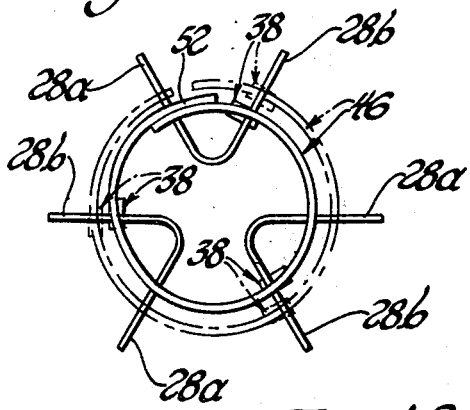

In the six-bar grates, shown by FIGS. 2 and 12, while there are generally oppositely-disposed bars, they do not lie on the diameter of the grate; rather, there are two sets of three bars, **28*a* and 28*b***, the three bars in each set being spaced 120° apart from each other.

It will now be apparent that the two-tab device 68 is particularly adapted for use with a grate having bars disposed on the diameter of the grate, such as a four or eight-bar grate, while the three-tab device 46 is specially suited for use with a three or six-bar grate.

Figure 10:
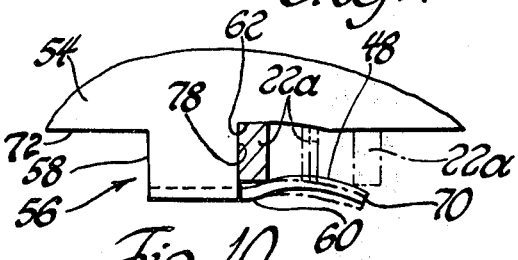
FIG. 10 is an enlarged fragmentary view of a portion of a device embodying the invention, as applied to a gas stove bar-type grate.

For example, FIG. 9 illustrates a two-tab device 68 setting on an eight-bar grate 14 wwith the two clips 48 merely positioned adjacent oppositely-disposed bars **22*a* lying on a diameter of the grate, so that device 68 is not yet attached to the grate. As shown, the clips 48 are formed so that rotation of the device 68 in a counterclockwise direction will cause the bar 22*a* adjacent each of the clips to force the free end 70 of leg 60 downwardly, as by cam action on the curved or clip portion 48 thereof, allowing the bar 22*a* to become lodged and retained in the notch 62 by the spring action of the clip 48, as shown in FIG. 10. That is, notch 62 may be formed so that the edge thereof slopes toward the bottom edge 72 of blank 54; thus, the bar 22*a* is retained between converging edge 62 and clip portion 48 so as to resist any tendency of the device 68 to rotate clockwise out of engagement with the grate 14**.

In FIG. 8, a two-tab device 68 is constructed with the free ends 70 of the L-shaped tabs 56 extending in the direction opposite from that shown in FIGS. 7, 9 and 10, so that clockwise, rather than counterclockwise, rotation of the device engages the grate bars **22*a***.

As seen from the solid-line portion of FIG. 12, wherein the ring 32 is not shown to simplify the view, the tabs 38 of a three-tab device 46, when the device 46 is in its normal or free smaller-diameter, overlapped-end 52 configuration, are each spaced and positioned to engage one bar **28*b*** of the two sets of three bars spaced 120° apart.

Referring now to FIGS. 7 and 8, it will be seen that the device 68 is formed with a relatively large notch 64 formed in the upper edge 66 of the device to receive the handle 74 portion of a coffee pot or other utensil 76, in the event that the handle 74 is positioned on the utensil so that it would otherwise engage the upper edge 66 of the device 68 and prevent the utensil 76 from resting properly on the grate. Obviously, the shape, size and location of notch 64 can be varied to suit any special requirements.

Figure 11:
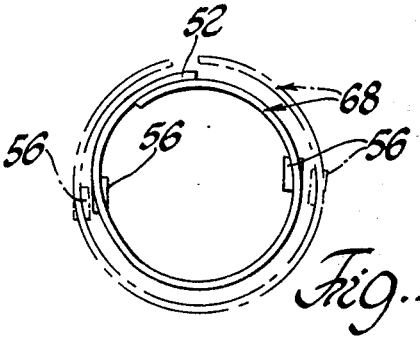
FIGS. 11 and 12 are schematic plan views illustrating how the expandable feature of a device embodying the invention adapts the same to different size utensils and types of grates.

FIGS. 11 and 12 illustrate two-tab and three-tab devices 68 and 46, respectively, the free, overlapped-end 52 conditions thereof being shown in solid lines, and the expanded, spaced-apart-end conditions thereof to receive a larger utensil being shown in broken lines.

The overlapped-end free condition 52, as opposed to a spaced-apart-end free condition, is the preferred structure because it will always retain a larger-diameter utensil by its tendency to return to its original smaller-diameter free condition, as compared to a non-overlapped device that would have to be contracted to restrain by close encirclement a smaller-diameter utensil.

It can be seen from FIGS. 10, 11 and 12, which admittedly are not necessarily dimensionally exact, but are intended only to schematically illustrate the general principle, that expanding either device 68 or device 46 from its overlapped-end condition 52, as to accommodate a larger-diameter utensil, does not change the circumferential location of the tabs 56 or 38, respectively, to the extent that the device will not still be capable of attachment to the bars of a grate for which it was intended. That is, the length of the clips and the flexibility of each of the cylindrical devices may be such that the device, although expanded, will still engage the grate bars effectively, although perhaps not as ideally as shown in FIG. 10 with the bar 22*a* engaging the inner edge 78 of the leg 56. For example, the bar 22*a* may be positioned at one of the broken line positions shown in FIG. 10 and still be effectively retained by the clip 48. This would be enhanced, for example, by making the notch 62 and the clip 48 longer than the width of the widest bar 22*a* to be encountered and shaping the edge of the notch 62 and the clip 48, as explained above, so that a device of particular configuration and dimension will maintain effective engagement with grate bars of slightly different widths and heights, and with bars that are not ideally located within the clips 48 due to expansion of the device to accommodate a larger utensil.

In summary, either embodiment of a device embodying the invention can be designed, with respect to shape, location and dimension of the tabs, the clips formed therefrom and the cooperating notches such that the device can be secured to grates of slightly varying design or dimensions or when the device is slightly contracted or expanded. In fact, it has been found, for example, that under certain conditions, such as when the device is located slightly off-center on the grate as shown by broken lines in FIG. 9, a three-tab device 46 will retain itself on certain eight-bar grates, or either device will engage the grate bars when it otherwise wouldn't. However, it is contemplated that both the two-tab and three-tab devices might preferably be made and purchased in sets of different diameter, so as to more easily accommodate a range of utensil sizes.

In any event, it should be noted that the device is secured to the stove by the tab clips 48, which function independently of any cooperation with any utensil-restraining stove structure. That is, there is no stove element, for cooperation with the clips 48 for retaining the utensil on the stove, other than the burner or heating element.

Figure 13:
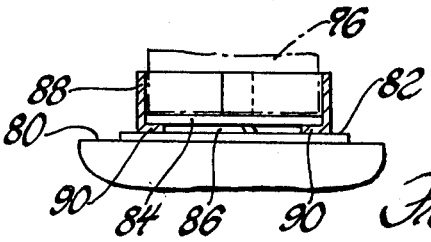
FIG. 13 illustrates how a device embodying the invention and adapted for use with a gas stove is also adaptable for use with an electric stove heating element.

While most motor homes, boats and other similar vehicles are equipped with gas stoves having bar grate structures such as those described above, it has been found that a device such as that shown and described herein can also be secured to household electric stoves, as shown by FIG. 13. Thus, a device embodying the invention could be used, for example, either for the purposes described above, if the motor home, boat or other vehicle is equipped with an electric stove, instead of a gas stove, or to prevent small children from pulling cooking utensils onto themselves, for example, in the home, even where the handle is not turned, as recommended, so as not to over hang the front of the stove.

In FIG. 13, the electric stove top 80 has resting thereon the support flange 82 of the usual dished drip pan, and the well-known spiral heating element 84 is mounted over the drip pan in a manner so that the bottom of the heating element is spaced from the top surface of the mounting flange, leaving space 86 therebetween. A two-tab or three-tab device 88, such as those already described above, can be expanded sufficiently to insert the inwardly-bent clips 90 into the space 86. Upon release of the device 88, it will, in contracting back to its free state, engage the heating element. A cooking utensil 96 can then be placed on the heating element 84 within the device 88. As in all applications of a device embodying the invention, the utensil must be lifted vertically out of the device; it cannot readily be tilted off the grate, due primarily to the fact that the utensil restraining or encircling portion thereof is a cylinder extending to a substantial height above the grate.

Since the device encircles the utensil, the gas flame may travel upwardly through the clearance between the device and the utensil, increasing the heating efficiency and heat retention of the utensil.

It will be apparent from the above specification and the drawings that the device, as described herein for purposes of illustration, is inexpensive to make, easy to use and well adapted to provide the objects and advantages, referred to above.

While there have been described what are at present believed to be the preferred embodiments of the invention, it will be apparent to those skilled in the art that various changes and modifications may be made herein without departing from the invention, and it is, therefore, intended to cover all such changes and modifications as fall within the spirit and scope of the invention.

Having thus described the invention in such clear and concise terms as to enable anyone skilled in the art to practice the same, what I claim as my invention is:

1. A device providing means for restraining an object such as a cylindrical cooking utensil from inadvertently or accidentally falling from a stove having a horizontally-disposed heating element and/or grate, said device comprising first means for restraining the utensil, said first means comprising a tubular, sheet metal or other body having upper and lower open ends, said body being split between said upper and lower ends to provide free ends at said split and adapted to receive untensils through said upper open end, said free ends of said body at said split being formed to overlap, whereby said body is resiliently expandable from its free-state overlapping configuration to substantially circumscribe utensils of varying diameters, and second means for removably securing said device to the stove, said second means comprising means extending from said lower open end and formed to have a side opening therein for receiving a portion of the stove heating element or grate upon horizontal movement of said second means.

2. A device particularly adapted for restraining a cooking utensil on a gas-type stove for mobile homes, boats and other vehicles subject to accelerations, braking, bumping and the like, the stove having a burner grate secured thereto, the burner grate including a plurality of horizontal, radially-extending grate bars for supporting the utensil, said bars having a particular cross-sectional height and width, said device comprising first hollow non-combustible cylinder means, said cylinder being open at both ends thereof and split lengthwise and having the free ends thereof at said split overlapping in the free state of said cylinder so that it is expansible and contractable in diameter to receive utensils of different cross-sectional dimension, one of said open ends being defined by the annular top end edge of the wall of said cylinder and the other of said open ends being defined by the annular bottom, grate-engaging end edge of said cylinder wall, and at least one second means extending from said cylinder adjacent said bottom edge thereof for securing said device to the grate, said second securing means comprising side-opening, clip-type means adapted to receive one of the radially-extending grate bars.

3. A device such as that recited in claim 2, wherein there are at least two of said second securing means, each for receiving one of at least two grate bars.

4. A device such as that recited in claim 3, wherein each of said second securing means comprises a generally L-shaped tab extending from said bottom grate-engaging edge and having the bottom leg thereof spaced from and extending parallel to said bottom edge, said bottom leg being bent inwardly toward and in a plane normal to the axis of said cylinder, the free end of each of said inwardly bent bottom legs extending in the same direction relative to said cylinder and being formed to provide a side-opening spring clip having a convergent attached portion and a divergent free end portion with respect to said adjacent bottom edge of cylinder, said free end being adapted to be displaced resiliently downwardly during insertion of a grate bar between said bottom edge and said leg.

5. A device such as that recited in claim 2, wherein said top edge of said cylinder wall is formed with a notch adapted to receive the handle of a utensil.

6. A device such as that recited in claim 4, wherein said bottom edge of said cylinder opposite said inwardly bent leg is formed with a notch cooperating with said leg to resiliently engage a grate bar therebetween.

7. A device such as that recited in claim 2 wherein the dimensions and configuration of said clip-type means are such as to provide means adapting said clip to receive and retain grate bars of varying cross-sectional height and width and to effectively grip any such grate bars when inserted into clip to varying degrees.

* * * * *